United States Patent [19]

Geiger

[11] 4,358,022

[45] Nov. 9, 1982

[54] PACKAGING UNIT

[76] Inventor: Albert Geiger, Breitenauerstrasse 1a, 8100 Garmisch-Partenkirchen, Fed. Rep. of Germany

[21] Appl. No.: 154,275

[22] Filed: May 29, 1980

[30] Foreign Application Priority Data

May 29, 1979 [DE] Fed. Rep. of Germany ..... 2921747

[51] Int. Cl.[3] ..... B65D 55/02

[52] U.S. Cl. ..... 215/224; 215/299

[58] Field of Search ..... 141/364, 326; 215/201, 215/211, 213, 215, 224, 225, 296, 299, 302; 220/284; 222/153; 206/1.5

[56] References Cited

U.S. PATENT DOCUMENTS

| | | | |
|---|---|---|---|
| 3,240,373 | 3/1966 | Dulle . | |
| 3,398,847 | 8/1968 | Towns . | |
| 3,556,331 | 1/1969 | Towns . | |
| 3,625,386 | 12/1971 | Schaefer . | |
| 3,759,411 | 9/1973 | Horvath . | |
| 3,843,008 | 10/1974 | Colella . | |
| 3,860,135 | 1/1975 | Yung et al. . | |
| 3,861,431 | 1/1975 | Ferguson | 141/364 |
| 3,924,768 | 12/1975 | Lemons . | |
| 4,098,417 | 7/1978 | Bennett . | |
| 4,098,418 | 7/1978 | Fields . | |
| 4,146,146 | 3/1979 | Mar . | |

FOREIGN PATENT DOCUMENTS 473018 7/1969 Switzerland .

*Primary Examiner*—Houston S. Bell
*Attorney, Agent, or Firm*—Stephen F. K. Yee

[57] ABSTRACT

A packaging unit has a container closed by a safety plug which has a maximum diameter equal to the outer diameter of the container opening and a smooth exterior to avoid any gripping surface. A cylindrical lip adjacent to the peripheral edge of the plug cooperates with the inner surface of the container opening to seal the opening. A slide is movable along a radial direction of the plug to extend beyond the edge of the container opening to provide a gripping surface for removing the plug. Safety detents may be provided which must be manipulated to permit movement of the slide.

20 Claims, 11 Drawing Figures

PACKAGING UNIT

BACKGROUND OF THE INVENTION

This invention relates to a packaging unit which prevents or restricts access to the contents. Such packaging units are widely used for medicinal preparations, paints, varnishes, cleansing agents, rust removal agents and the like. These units generally include a container having a closure or plug which is designed to be difficult to open or remove. The closure or plug is often termed "safety closures" or "safety plugs", and inasmuch as primarily children make up the group of people to whom unwarranted opening is to be denied, they are often called "childproof closures".

A known design for a safety closure consists essentially of an internal cylinder provided with a sealing lip or bead and a flange-like continuation of the cylinder which mounts on the edge of the container opening. If desired, a retaining means for the contents may be provided which projects into the interior of the container.

An object of the invention is to provide a packaging unit with a safety closure which is simple and cheap to produce and which can be filled and sealed on standard automated packing lines such as are in existence in industry, and in the pharmaceutical industry in particular, without the need for significant modification.

This object is attained by the present invention in which a flange-like part of the safety closure projecting above the edge of the container opening has a maximum external diameter equal to the external diameter of the opening and tapers from the edge of the opening to the center so that no grippable peripheral area is provided and in which a slide is mounted in a flange-like part of the closure to move radially to provide a surface which may be used to remove the closure from the opening.

The invention is described in greater detail by means of example embodiments and reference to the drawings.

DETAILED DESCRIPTION OF THE PREFERRED EMBODIMENTS

Figure 1:
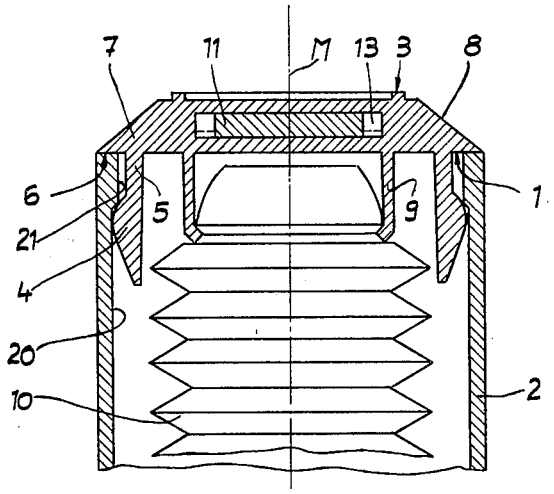
FIG. 1 is a longitudinal section through a packaging unit according to the invention, in the area of the container opening.

Only the upper part of the container 2 of the packaging unit directly adjoining the mouth or opening 1 is shown in the embodiments exemplifying the invention. The exterior surface of the container 2 adjacent to the opening 1 is free of any radial projections or protruberences.

The safety closure, or plug, generally designated as 3, includes an internal cylinder 5 provided with sealing means in the form of a torus 4, and a flange-like part 7 projecting above the edge 6 of the opening 1. The maximum external diameter of the flange-like part 7, as shown in FIGS. 1 through 6, is equal to the external diameter of the container 2 at the opening 1, and the thickness decreases in the direction away from the centerline M so that a sloped surface 8 is formed, (tapered in cross section), with the result that no peripheral surface is created which can be gripped for removal of the plug, for which reason the container cannot be readily opened.

Another internal cylinder 9 in the safety closure 3 can accommodate a contents retaining means in the form of a bellows 10.

Figure 11:
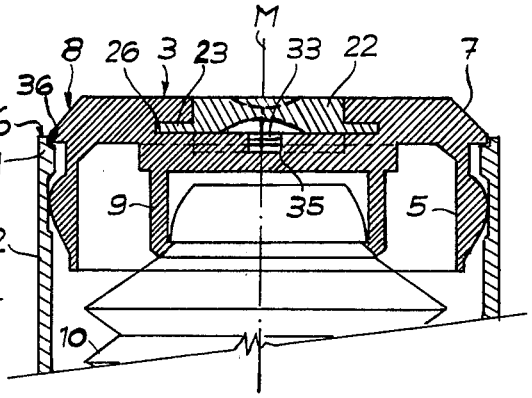
FIG. 11 is a section along line XI—XI in FIG. 9, with the slide inserted.

Opening of the container is made possible by a slide 11 which can be displaced radially so that a portion extends over the outer edge of the opening 1 (FIGS. 1 through 3), 12 (FIGS. 4 through 6) or 22 (FIGS. 7 And 11) to permit removal of the safety closure 3.

The slide 11 is movably mmounted in a slot 13 provided within the safety closure 3, and the outer end portion 14 of the slide is accessible from above, making it possible to move the slide in the direction of arrows A, from the closed position (solid lines, FIG. 2) to the open position (broken lines, FIG. 2) or to return it to the closed position. To facilitate this movement, the outer end portion 14 of the slide 11 is provided with an indentation or recessed portion 15 into which the user can insert a fingernail.

Complete withdrawal of the slide 11 is prevented by lateral projections 16 acting in conjunction with a lateral extension 17 of the slot 13. A slot 18, in the form of a circular sector, in the sloped surface 8 is provided for the insertion of the slide 11 into the slot 13 during manufacture of the safety closure 3. The slide 11, like the closure 3, is preferably made of a plastic material, and being flexible can be bent slightly until its projections 16 are locked in the extension 17.

Figure 3:
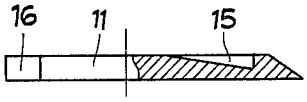
FIG. 3 is a side view, partly cut away, of the slide shown in FIGS. 1 and 2.
Figure 2:
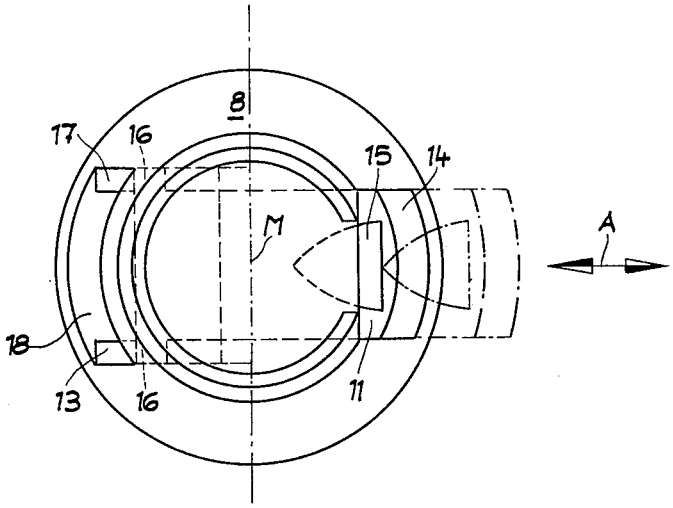
FIG. 2 is a top view of the unit shown in FIG. 1.
Figure 4:
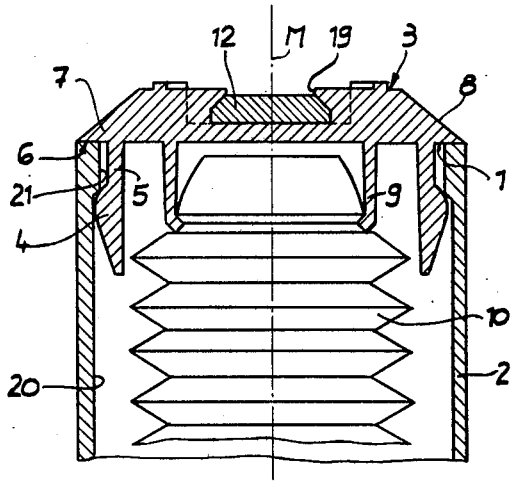
FIG. 4 is a longitudinal section through a modified embodiment of the packaging unit.
Figure 6:
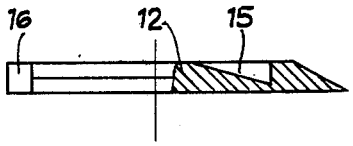
FIG. 6 is a side view, partly cut away, of the slide shown in FIGS. 4 and 5.
Figure 5:
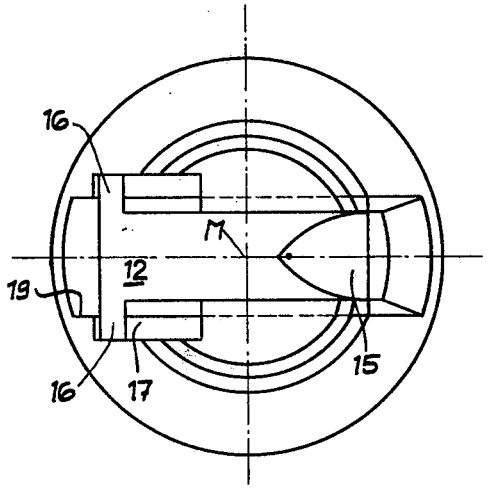
FIG. 5 is a top view of the unit shown in FIG. 4.
Figure 7:
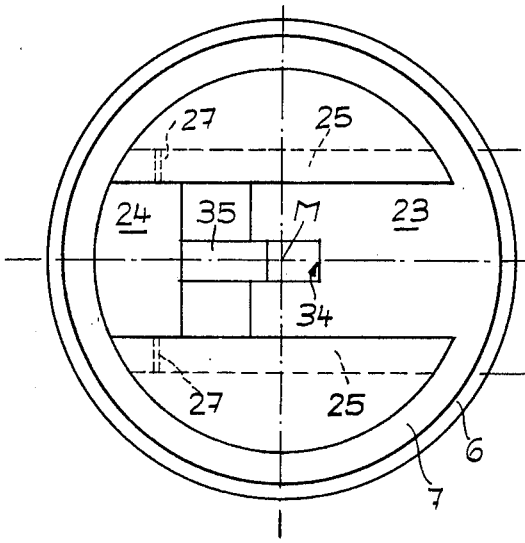
FIG. 7 is a top view of a third embodiment of a safety closure according to the invention (without slide).
Figure 8:
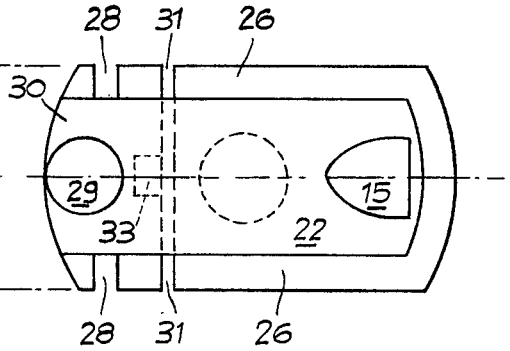
FIG. 8 is a top view of the slide for the embodiment of FIG. 7.
Figure 9:
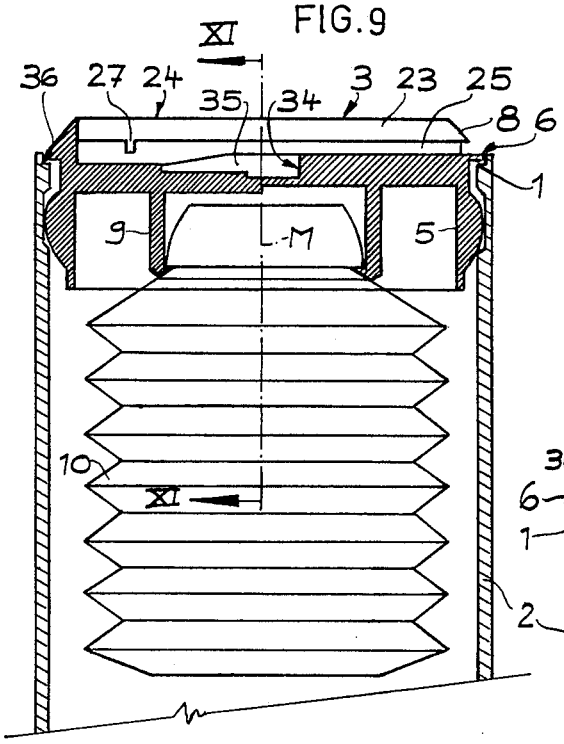
FIG. 9 is a longitudinal section through the unit shown in FIG. 7.
Figure 10:
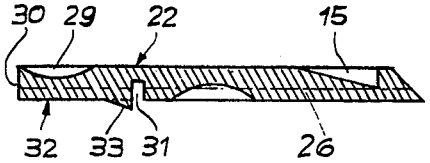
FIG. 10 is a longitudinal section through the slide shown in FIG. 9.

The embodiment illustrated in FIGS. 4–6 differs from that shown in FIGS. 1–3 primarily in that the slide 12 is not mounted in a closed slot, but is mounted in an open groove 19 having a cross-sectional shape of a swallowtail. The cross section of the slide 12 is accordingly not rectangular, as in the case of the slide 11 (see FIG. 1), but rather, as shown in FIG. 4, is adapted to the shape of this groove. The lateral projections 16 on the slide 12 and the lateral extension 17 of the groove 19, by means of which accidental complete withdrawal of the slide from the groove is prevented, are present in this embodiment as well.

As indicated by broken lines in FIGS. 2, the portion of the slide 11 projecting beyond the flange-like part 7 forms a handle which makes it possible to lift the closure 3 upward and at the same time to overcome an undercut 20 on the inner surface 21 of the container 2, adjacent to the opening 1. This is true also for the embodiment shown in FIGS. 4–6.

An especially childproof and thus preferable embodiment of the invention is illustrated in FIGS. 7 through 10. The slide 22 in this case has a T-shaped cross section, for example, and is mounted in a groove 23 of corresponding shape. The depth of the groove 23 is greater in the rear or inner area 24 of the groove than in the for-greater than the height of said projection to provide a clearance beneath said projection, and said member is adapted to be depressed to place said notch within said clearance, thereby releasing said notch from restraining engagement with said projection and permitting said member to be moved to said second position.

10. A packaging unit as defined in claim 9, further comprising a transverse groove on the inner surface of said member, intermediate its end portions, to enhance the deflection flexibility of said member.

11. A packaging unit as defined in claim 1, further comprising means supported from the inner surface of said closure for immobilizing contact with the contents of said container with said closure closing said opening.

12. A removal-resistant closure for application to a container to close the container opening, comprising:

a tubular portion receivable within the container opening having an exterior projecting surface cooperating with the wall of the container opening to retain the closure on the container;

a slidable removal assisting member on said closure adapted to be displaced from a first position wherein said member is positioned within the peripheral confines of said closure, to a second position wherein a portion of said member extends beyond the periphery of said closure to provide a surface against which a force may be applied to remove said closure;

stop means on said closure; and coacting means on said slidable member cooperating with said stop means to prevent removal of said member from said closure.

13. A closure as defined in claim 12, wherein said member is slidablly movable within guide means provided in said closure and said member is further provided on its exterior surface with an engagement surface to which displacement force may be applied to slidably move said member.

14. A closure as defined in claim 13, wherein said guide means includes spaced, parallel channels having stop means at one end and laterally-extending tabs on an end portion of said member are slideably received within said channels, said tabs coacting with the stop means of said channels to define said second position of said member.

15. A closure as defined in claim 13, wherein said guide means includes spaced, parallel channels and lateral projections on said member are slideably received within said channels and further comprising means on said closure on said slide which cooperate to define said first and said second positions of said member.

16. A closure as defined in claim 15, wherein said position defining means includes:

a projection at one end portion of said channel, extending toward the inner surface of said closure;

an indentation in said closure, disposed between said channels;

a notch in one of said lateral projections of said member, said notch being located to receive said projection with said member in said first position, said projection and said notch cooperating to maintain said member in said first position; and a pendent element on the inner surface of said member which cooperates with said indentation to stop said member in said second position and to prevent removal of said member.

17. A closure as defined in claim 16, further comprising release means selectively operable to release said member for movement from said first position to said second position.

18. A closure as defined in claim 17, wherein the depth of said channel in the region of said projection is greater than the height of said projection to provide a clearance beneath said projection, and said member is adapted to be depressed to place said notch within said clearance, thereby releasing said notch from restraining engagement with said projection and permitting said memberf to be moved to said second position.

19. A closure as defined in claim 18, further comprising a transverse groove on the inner surface of said member, intermediate its end portions, to enhance the deflection flexibility of said member.

20. A closure as defined in any of claims 12–19, wherein the exterior surface of the closure adjacent to the periphery is sloped to the edge of the closure and the maximum dimensional extent of the closure is substantially equal to the exterior dimensional extent of the container at the opening, the dimensional extent and smooth, sloped exterior surface cooperating to avoid any surface which is useful in removing the closure from the container opening.

* * * * *

UNITED STATES PATENT AND TRADEMARK OFFICE

CERTIFICATE OF CORRECTION

PATENT NO. :4,358,022

DATED :November 9, 1982

INVENTOR(S) :Albert Geiger

It is certified that error appears in the above-identified patent and that said Letters Patent is hereby corrected as shown below:

Column 2, line 22, "And" should read -- and --.

Column 2, line 24, "mmounted" should read -- mounted --.

Column 6, line 3, "closure on" should read -- closure and on --.

Column 6, line 33, "memberf" should read -- member --.

Signed and Sealed this

*Thirtieth* Day of *August 1983*

[SEAL]

*Attest:*

GERALD J. MOSSINGHOFF

*Attesting Officer*

*Commissioner of Patents and Trademarks*